US006890147B2

(12) United States Patent
Pecchioli

(10) Patent No.: US 6,890,147 B2
(45) Date of Patent: May 10, 2005

(54) EASY-FIT HEAT SCREENING DEVICE FOR CONNECTING A COOLING PIPE AND A THROUGH-HOLE FORMED IN A NOZZLE SUPPORT RING OF A GAS TURBINE

(75) Inventor: Mario Pecchioli, Prato (IT)

(73) Assignee: Nuovo Pignone Holding S.p.A., Florence (IT)

( * ) Notice: Subject to any disclaimer, the term of this patent is extended or adjusted under 35 U.S.C. 154(b) by 9 days.

(21) Appl. No.: 10/608,553

(22) Filed: Jun. 30, 2003

(65) Prior Publication Data

US 2004/0057825 A1 Mar. 25, 2004

(30) Foreign Application Priority Data

Jul. 3, 2002 (IT) ..... MI2002A1465

(51) Int. Cl.[7] ..... F01D 5/14

(52) U.S. Cl. ..... 415/115; 415/116; 415/136

(58) Field of Search ..... 415/115–117, 176, 415/136–138, 173.7, 174.4, 189, 209.2–209.4, 190

(56) References Cited

U.S. PATENT DOCUMENTS

| | | | | | |
|---|---|---|---|---|---|
| 3,574,354 | A | * | 4/1971 | Mischel | 285/16 |
| 5,517,817 | A | * | 5/1996 | Hines | 60/805 |
| 6,382,906 | B1 | * | 5/2002 | Brassfield et al. | 415/115 |
| 6,398,485 | B1 | * | 6/2002 | Frosini et al. | 415/115 |

* cited by examiner

*Primary Examiner*—F. Daniel Lopez
*Assistant Examiner*—James M. McAleenan
(74) *Attorney, Agent, or Firm*—Nixon & Vanderhye

(57) ABSTRACT

An easy-fit heat screening device (110) for connecting a cooling pipe (112) and a through-hole (114) formed in a nozzle support ring (116) of a gas turbine, of the type comprising a tubular structure (118) which has an external diameter smaller than a diameter of the through-hole (114) and into which the cooling pipe (112) extends; this tubular structure (118) has at the top a shaped annular end (126) which is inserted inside a groove (130) formed in the through-hole (114).

17 Claims, 3 Drawing Sheets

EASY-FIT HEAT SCREENING DEVICE FOR CONNECTING A COOLING PIPE AND A THROUGH-HOLE FORMED IN A NOZZLE SUPPORT RING OF A GAS TURBINE

BACKGROUND OF THE INVENTION

The present invention refers to an easy-fit heat screening device for connecting a cooling pipe and a through-hole formed in a nozzle support ring of a gas turbine.

As is known, gas turbines are machines consisting of a compressor and single or multiple-stage turbine, where these components are connected together by a rotating shaft and where a combustion chamber is provided between the compressor and the turbine.

In these machines, air from the external environment is supplied to the compressor so as to pressurise it.

The pressurised air passes through a series of pre-mixing chambers which terminate in a converging portion and inside each of which an injector feeds the fuel which is mixed with the air so as to form an air/burning fuel mixture.

The fuel is introduced inside the combustion chamber and is ignited by means of suitable sparking plugs so as to produce combustion which is aimed at causing an increase in temperature and pressure and therefore enthalpy of the gas.

At the same time, the compressor supplies pressurised air which is made to pass both through the burners and through the casing of the combustion chamber so that the above-mentioned pressurised air is available for fuelling the combustion.

Then the high-temperature and high-pressure gas reaches, via suitable ducts, the different stages of the turbine which converts the enthalpy of the gas into mechanical energy which is available to the user.

It is known, moreover, that in order to achieve the maximum efficiency of a given gas turbine it is necessary for the temperature of the gas to be as high as possible; however, the maximum temperature values which can be reached during use of the turbine are limited by the strength of the materials used.

Furthermore, in gas turbines, as in other turbine machines, it is necessary to prevent these hot gases from being drawn into spaces which are situated around the impellers of the said turbines.

It is therefore necessary to pressurise suitably the cavities which are adjacent to the fluid path so as to prevent a reduction in the efficiency and excessively high operating temperatures of the turbine impellers.

In the known art, cooling pipes are used for this purpose, said pipes conveying a cooling air which is supplied from the compressor and having, for example, to pass through the nozzles of the first low-pressure stage (which are thus provided with suitable holes) and through the nozzle support ring, in order to reach the zones to be pressurised.

In particular, the air which is tapped from the compressor has a temperature which is considerably lower than the operating temperature of the nozzle support ring. In order to avoid—in the zones where the cooling pipes pass through a through-hole formed in the nozzle support ring—the spread of high temperatures inside the said support ring, heat screening devices have been introduced.

These devices are arranged between the cooling pipe and the through-hole of the nozzle support ring and comprise a tubular structure.

It is pointed out, moreover, that these tubular structures also perform another function. In fact they act as a seat for the cooling pipe and ensure a sealed connection with the through-hole formed in the nozzle support ring.

The cooling pipe, which generally has spherical ends, departs from an external casing of the turbine and terminates inside the through-hole of the nozzle support ring.

In some types of gas turbine, the seat for the spherical end of the cooling pipe is provided by a bush inserted from the outside of the nozzle support ring and locked with a ring nut on the inside of the ring itself. This is possible when the through-holes passing through the nozzle support ring are straight, there being only one zone where pressurisation is to be performed.

In gas turbines, however, where there are two zones to be supplied, the through-holes passing through the nozzle support ring are of two types: one which is straight and the other inclined. In this case, in the prior art, two different types of fixing devices are used, one for straight holes and one for inclined holes, using also two different fixing methods.

BRIEF SUMMARY OF THE INVENTION

The object of the present invention is therefore that of overcoming the abovementioned drawbacks and in particular that of providing an easy-fit heat screening device for connecting a cooling pipe and a through-hole formed in a nozzle support ring of a gas turbine which can be applied equally well to straight holes and inclined holes.

Another object of the present invention is that of providing an easy-fit heat screening device for connecting a cooling pipe and a through-hole formed in an nozzle support ring of a gas turbine which allows a reduction in production and maintenance costs compared to the prior art.

Another object of the present invention is that of providing an easy-fit heat screening device for connecting a cooling pipe and a through-hole formed in a nozzle support ring of a gas turbine which is particularly reliable, simple and functional.

These and other objects according to the present invention are achieved by providing an easy-fit heat screening device for connecting a cooling pipe and a through-hole formed in a nozzle support ring of a gas turbine as described in claim 1.

BRIEF DESCRIPTION OF THE DRAWINGS

The characteristic features and advantages of an easy-fit heat screening device for connecting a cooling pipe and a through-hole formed in a nozzle support ring of a gas turbine according to the present invention will emerge more clearly and fully from the following description provided by way of a non-limiting example with reference to the accompanying schematic drawings in which.

DETAILED DESCRIPTION OF THE INVENTION

Figure 1:
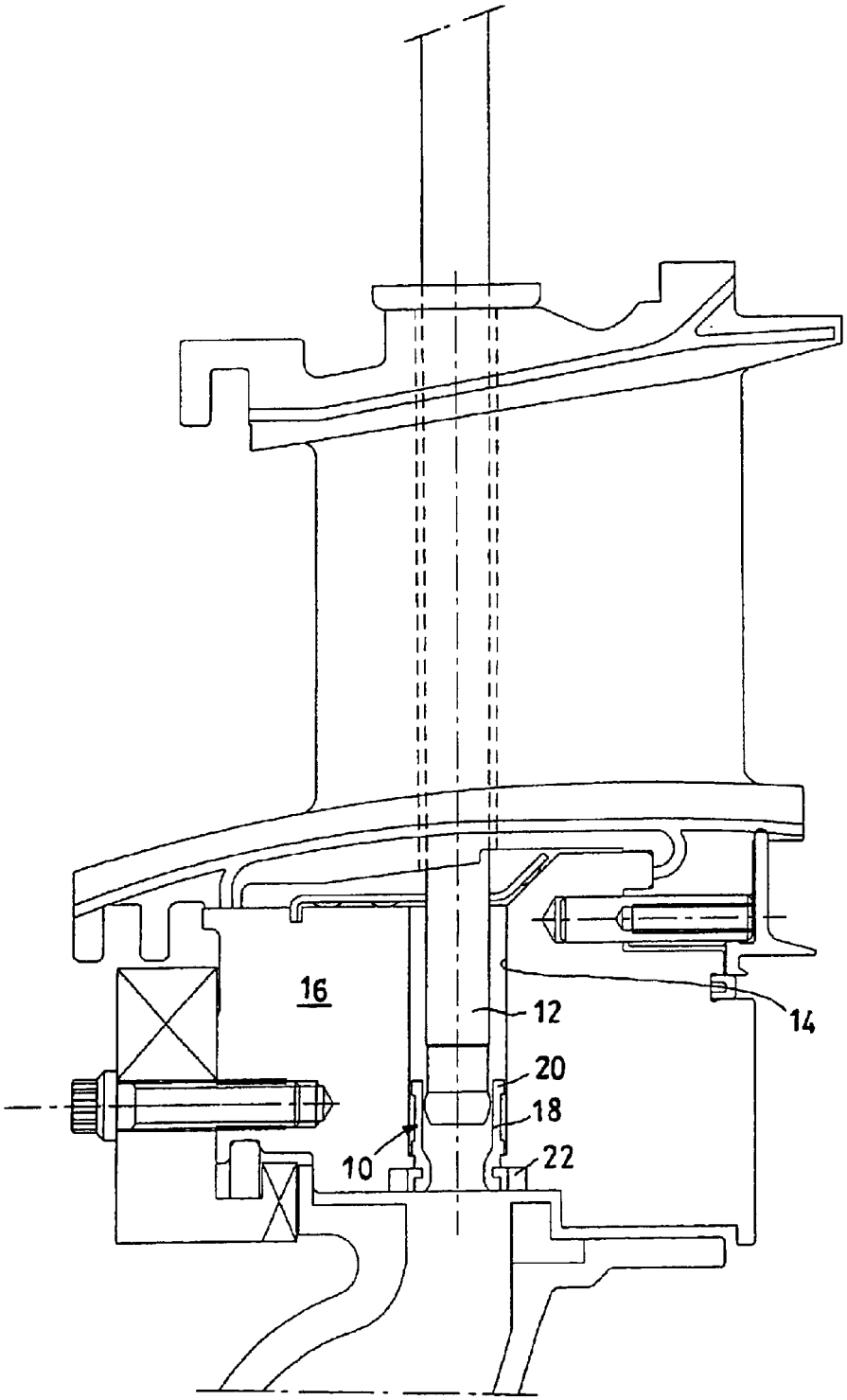
FIG. 1 is a cut-away side elevation view of a connection between a cooling pipe and a straight through-hole formed in a nozzle support ring of a gas turbine, with a heat screening device according to the prior art inserted therein.

With reference to FIG. 1, a heat screening device according to the prior art is indicated overall by 10, said device being intended to join together a cooling pipe 12 and straight through-hole 14 formed in a nozzle support ring 16 of a gas turbine.

In the example according to FIG. 1, the screening device 10 comprises a tubular structure 18 having a top end 20 with an external diameter approximately equal to an internal diameter of the through-hole 14.

This tubular structure 18 is inserted from the outside of the nozzle support ring 16 and is arranged at a bottom end of the through-hole 14, being locked there by a ring nut 22 mounted on the inside of the said ring 16 so as to support the overlying tubular structure 18.

A bottom—generally spherical—end of the cooling pipe 12 extends inside the tubular structure 18.

FIGS. 2, 3, 4 and 5 illustrate an easy-fit heat screening device 110, according to the present invention, for connecting a cooling pipe 112 and a through-hole 114 formed in a nozzle support ring 116 of a gas turbine, where components identical/or equivalent to those illustrated in FIG. 1 have the same reference numbers increased of 100.

Figure 3:
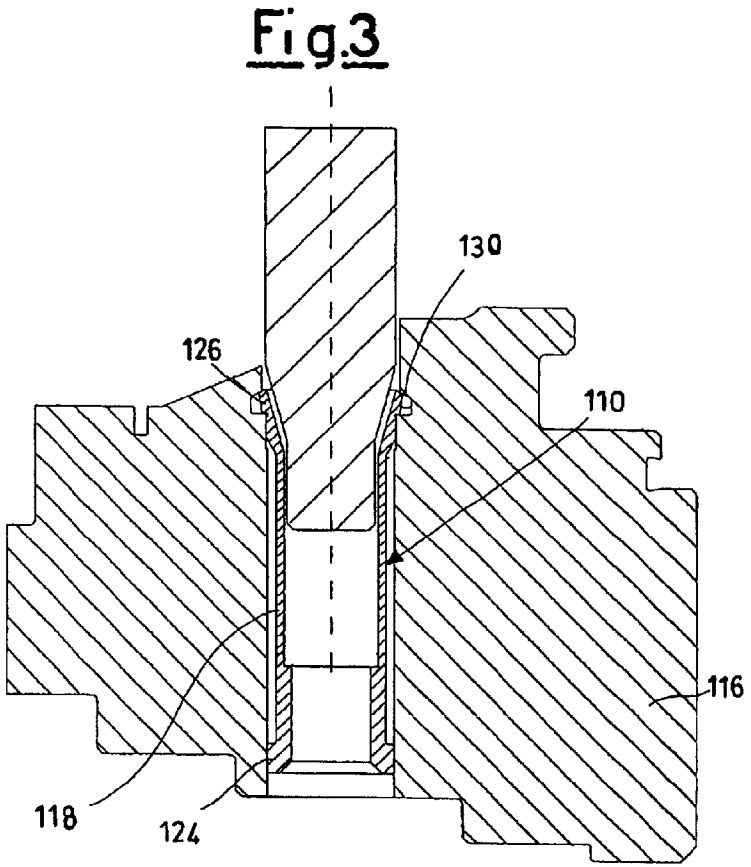
FIG. 3 shows a sectioned side elevation view of a connection between a cooling pipe and a straight through-hole formed in a nozzle support ring of a gas turbine, where a system for fixing a heat screening device according to the present invention using a mounting tool is shown.
Figure 2:
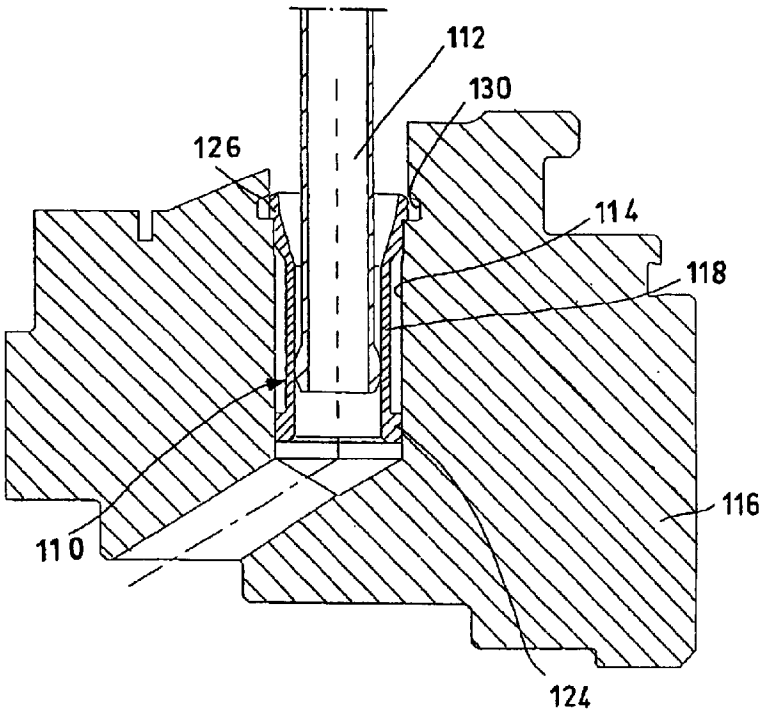
FIG. 2 shows a sectioned side elevation view of a connection between a cooling pipe and a through-hole, having two inclined sections formed in a nozzle support ring of a gas turbine, in one section there being inserted an easy-fit heat screening device according to the present invention.

More precisely, FIG. 2 shows a through-hole 114 having two sections inclined with respect to each other, whereas FIG. 3 shows a straight through-hole 114.

Figure 5:
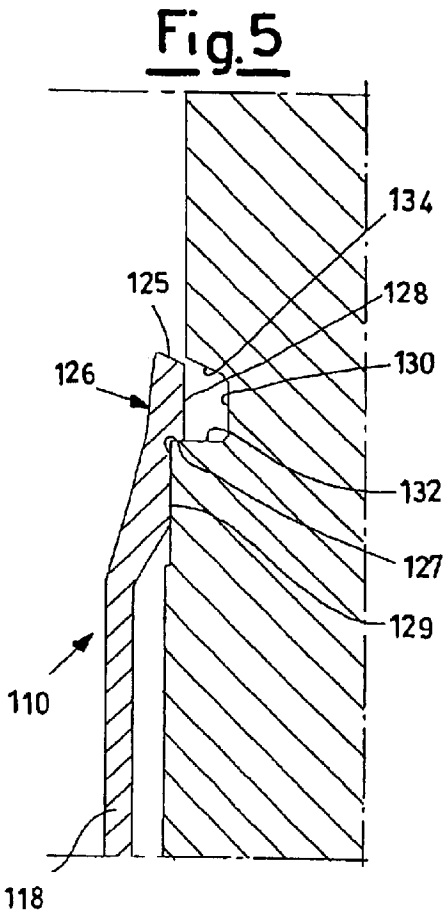
FIG. 5 shows an enlarged view of FIG. 3 illustrating a top end of the heat screening device according to the present invention, before use of a mounting tool.

In both cases and as can be clearly seen in FIG. 5, an upper zone of the through-hole 114 has a groove 130. The groove 130 is defined at the bottom by a first flat surface 132 which is substantially perpendicular to the axis of this upper zone and at the top by a second flat surface 134 having an inclination along a line directed towards an outer extension of the first surface 132.

The upper zone of the through-hole 114 has, above the groove 130, a first internal diameter greater than a second internal diameter provided underneath the said groove 130.

The screening device 110 comprises a tubular structure 118. This tubular structure 118 is inserted from the outside of the nozzle support ring 116 and is arranged inside the through-hole 114.

The tubular structure 118 has at the bottom an annular end 124 with an external diameter which is approximately equal to the second internal diameter of the through-hole 114.

At the top, the tubular structure 118 has a shaped annular end 126.

As can be clearly seen in FIG. 5, an external surface of the shaped annular end 126 is formed with two different diameters. At the top a first external cylindrical surface 128 is provided, said surface having a diameter slightly smaller than the first internal diameter of the through-hole 114. At the bottom there is a second external cylindrical surface 129, with a diameter slightly smaller than the second internal diameter of the through-hole 114.

The first external cylindrical surface 128 is joined to the second external cylindrical surface 129 by a flat annular surface 127 which extends substantially perpendicularly with respect to the axis of the upper zone of the through-hole 114.

Finally, the shaped annular end 126 terminates at the top in a flat surface 125, having an inclination along a line directed towards an outer extension of the flat annular surface 127.

A bottom—generally spherical—end of the cooling pipe 112 extends inside the tubular structure 118.

The operating principle of the easy-fit heat screening device 110 for connecting a cooling pipe 112 and a through-hole 114 formed in a nozzle support ring 116 of a gas turbine, according to the present invention, is clear from that described above with reference to the figures and briefly is as follows.

The heat screening device 110 is inserted, from outside of the nozzle support ring 116, into the upper zone of the through-hole 114. Insertion is performed so that the flat annular surface 127 mates with the first flat surface 132 of the groove 130.

At this point, in order to lock the heat screening device 110 inside the through-hole 114, the shaped annular end 126 is engaged inside the groove 130.

More precisely, the shaped annular end 126 is bent, as can be seen in FIG. 3, using for example a mounting tool with a conical end which is inserted from the outside of the nozzle support ring 116.

Figure 4:
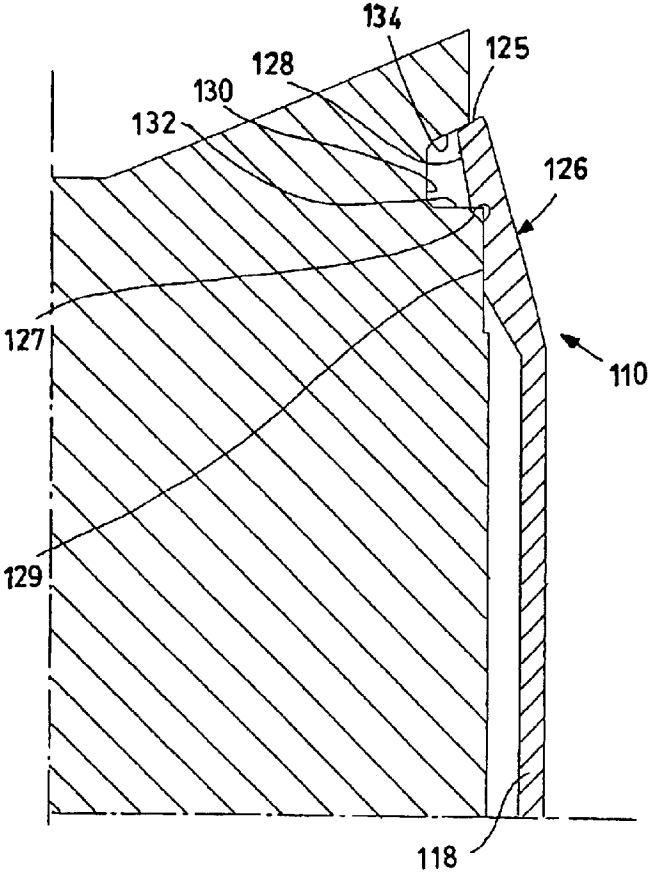
FIG. 4 shows an enlarged view of FIG. 3 illustrating a top end of the heat screening device according to the present invention, after use of a mounting tool.

After this operation, as shown in FIG. 4, the shaped annular end 126 enters partly inside the groove 130; in particular, the flat surface 125 of the shaped annular end 126 engages in an interfering manner with part of the second flat surface 134.

It is clear that the first external cylindrical surface 128 is designed with dimensions suitable for this purpose: the inclination of the second flat surface 134 is also approximately parallel to the inclination of the flat surface 125 of the shaped annular end 126 such that, after bending of the shaped annular end 126, the flat surface 125 makes firm contact with the second flat surface 134.

The heat screening device 110 advantageously uses an oil-hydraulic apparatus equipped with the conical-end mounting tool and able to generate a thrust, for example, of 10,000 Newton.

It should be noted how, in order to lock the device 110, it is necessary to act exclusively on the outside of the nozzle support ring 116.

It must also be pointed out how the material from which the heat screening device 110 according to the invention is made must have, in addition to heat resistance characteristics, also good plastic deformation properties required for bending of the shaped annular end 126.

The description provided clearly illustrates the characteristic features of the easy-fit heat screening device for connecting a cooling pipe and a through-hole formed in a nozzle support ring of a gas turbine according to the present invention, as well as the advantages associated therewith, including:

simple installation and maintenance;

reliability;

lower costs, compared to the prior art, since there is a single heat screening device suitable for both a straight cooling pipe and a pipe with two sections inclined relative to each other: the reduction in the costs arises from the fact that use of the device according to the invention, although it requires a special tool, is industrially more simple than the prior art where it was required to perform a final safety spot weld.

Finally, it is clear that the easy-fit heat screening device for connecting a cooling pipe and a through-hole formed in a nozzle support ring of a gas turbine thus conceived may be subject to numerous modifications and variants, all of which fall within the scope of the invention; moreover, all the details may be replaced by technically equivalent elements. In practice the materials used, as well as the forms and the dimensions may be of any nature according to the technical requirements.

The scope of protection is therefore defined by the accompanying claims.

What is claimed is:

1. In a gas turbine including a nozzle support ring having a through hole and a cooling pipe received at least in part in said through hole, the improvement comprising an easy fit heat screening device for connecting said cooling pipe and said nozzle support ring and including a tubular structure having an external diameter smaller than a diameter of said through hole, said cooling pipe extending at least in part in said tubular structure, said nozzle support ring having a groove formed in said through hole, said tubular structure having a shaped outer annular end portion received in said groove.

2. A heat screening device according to claim 1 wherein said shaped annular end portion is received in said groove by bending said shaped annular end.

3. A heat screening device according to claim 2 wherein said shaped annular end portion is bent using a mounting tool with conical ends inserted from the outside of said nozzle support ring.

4. A heat screening device according to claim 1 including an interference fit between said shaped annular end and said groove.

5. A heat device according to claim 4 wherein said groove is formed in an upper zone of said through hole, said groove being defined at a bottom thereof by a first flat surface and at a top thereof by a second flat surface with an inclination along a line directed towards an outer extension of said first flat surface.

6. A heat screening device according to claim 5 wherein said first flat surface is substantially perpendicular to the axis of said upper zone of said through hole, said upper zone of said through hole having above said groove a first internal diameter which is greater than a second internal diameter provided underneath said groove.

7. A heat screening device according to claim 6 wherein an external surface of said shaped annular end is formed with two different diameters, a first external cylindrical surface adjacent a top of said shaped annular end having a diameter slightly smaller than said first internal diameter of said through hole, and adjacent a bottom thereof a second external cylindrical surface having a diameter slightly smaller than said second internal diameter of said through hole.

8. A heat screening device according to claim 7 wherein said first external cylindrical surface is joined to said second external cylindrical surface by a flat annular surface which extends substantially perpendicularly with respect to the axis of said upper zone of said through hole.

9. A heat screening device according to claim 8 wherein said shaped annular end portion terminates at a top thereof in a flat surface with an inclination along a line directed towards an outer extension of said flat annular surface.

10. A heat screening device according to claim 9 wherein said tubular structure is inserted from outside of said nozzle support ring into said upper zone of the through hole such that said flat annular surface mates with said first flat surface of said groove.

11. A heat screening device according to claim 9 wherein said flat surface of said shaped annular end engages in an interfering fit with part of said second said flat surface of said groove.

12. A heat screening device according to claim 11 wherein the inclination of said second flat surface is approximately parallel to the inclination of said flat surface of said shaped annular end portion such that bending said shaped annular end portion enables said flat surface to make firm contact with said second flat surface.

13. A heat screening device according to claim 6 wherein said tubular structure has at a bottom thereof an annular end with an external diameter approximately equal to said second internal diameter of said through hole.

14. A heat screening device according to claim 1 wherein said through hole is straight.

15. A heat screening device according to claim 1 wherein said through hole includes two sections inclined with respect to each other.

16. A heat screening device according to claim 1 wherein a bottom end of said cooling pipe is inserted inside said tubular structure.

17. A heat screening device according to claim 16 wherein said bottom end of said cooling pipe includes a spherical portion.

* * * * *